US011628973B2

(12) United States Patent
Robin et al.

(10) Patent No.: US 11,628,973 B2
(45) **Date of Patent: *Apr. 18, 2023**

(54) IMPACT-PROTECTION DEVICE CAPABLE OF BEING PROVIDED ON A BOTTLE

(71) Applicant: VIRBAC, Carros (FR)

(72) Inventors: Michel Robin, Antibes (FR); Laurent Rodrigues, Le Cannet (FR); Arnaud Steiner, La Colle sur Loup (FR); Benoît Berny, Voeuil et Giget (FR)

(73) Assignee: VIRBAC, Carros (FR)

( * ) Notice: Subject to any disclaimer, the term of this patent is extended or adjusted under 35 U.S.C. 154(b) by 0 days.

This patent is subject to a terminal disclaimer.

(21) Appl. No.: 17/697,412

(22) Filed: Mar. 17, 2022

(65) Prior Publication Data

US 2022/0204214 A1 Jun. 30, 2022

Related U.S. Application Data

(62) Division of application No. 17/048,949, filed as application No. PCT/EP2019/059555 on Apr. 12, 2019, now Pat. No. 11,325,748.

(30) Foreign Application Priority Data

Apr. 20, 2018 (FR) ..... 1853479

(51) Int. Cl.
*B65D 23/12* (2006.01)
*B65D 23/08* (2006.01)
*B65D 81/02* (2006.01)

(52) U.S. Cl.
CPC ..... *B65D 23/0885* (2013.01); *B65D 81/022* (2013.01)

(58) Field of Classification Search
CPC ..... B65D 23/0885; B65D 81/022
(Continued)

(56) References Cited

U.S. PATENT DOCUMENTS 596,304 A * 12/1897 Paquette ..... A47J 41/02 215/12.1
2,706,571 A * 4/1955 Ryan ..... A61J 9/08 215/11.6

(Continued)

FOREIGN PATENT DOCUMENTS

CN 2338285 Y 9/1999
CN 2640934 Y 9/2004

(Continued)

OTHER PUBLICATIONS

International Search Report from corresponding International Application No. PCT/EP2019/059555, dated May 29, 2019, pp. 1-2, European Patent Office, Rijswijk, The Netherlands.

(Continued)

*Primary Examiner* — Luan K Bui
(74) *Attorney, Agent, or Firm* — Hauptman Ham, LLP

(57) ABSTRACT

A device for protecting against shocks for a glass bottle is presented, having a body, a bottom and a distal portion successively comprising from the body, a shoulder, a collar and a neck, said device comprising a first cup engaging with the bottom and a second cup engaging with the shoulder, each of the cups having a projecting portion for damping shocks, along a transversal plane, beyond a zone of a larger diameter of the bottle. The projecting portion of at least one from among the first and the second cups includes a plurality of damping pads spaced apart from one another.

25 Claims, 3 Drawing Sheets

(58) Field of Classification Search
USPC ..... 206/521, 591, 592, 594; 215/12.1, 269, 215/386, DIG. 6
See application file for complete search history.

(56) References Cited

U.S. PATENT DOCUMENTS

| | | | | |
|---|---|---|---|---|
| 2,838,226 | A | 6/1958 | Hartmann et al. | |
| 3,372,826 | A | 3/1968 | Heaton | |
| 3,513,970 | A | 5/1970 | Eckholm, Jr. | |
| 3,613,761 | A | 10/1971 | Moody | |
| 3,698,586 | A | 10/1972 | Terner | |
| 3,967,993 | A | 7/1976 | Isomi | |
| 3,972,435 | A | 8/1976 | Sasaki et al. | |
| 4,300,612 | A * | 11/1981 | Schroeder, Jr. | B65D 23/0885 220/675 |
| D878,214 | S * | 3/2020 | Robin | D9/434 |
| 2013/0233754 | A1* | 9/2013 | Liu | B65D 81/057 206/521 |

FOREIGN PATENT DOCUMENTS

| | | | |
|---|---|---|---|
| CN | 201755321 | U | 3/2011 |
| CN | 201912469 | U | 8/2011 |
| FR | 10567 | E | 7/1909 |
| FR | 3028501 | A1 | 5/2016 |
| GB | 357678 | | 10/1931 |
| WO | 2010063919 | A1 | 6/2010 |
| WO | 2014128179 | A1 | 8/2014 |

OTHER PUBLICATIONS

Written Opinion from corresponding International Application No. PCT/EP2019/059555, pp. 1-6, European Patent Office, Rijswijk, The Netherlands.

Chinese Office Action issued from corresponding Chinese Application No. 201980027072.6, dated Nov. 3, 2021, pp. 1-10.

* cited by examiner

IMPACT-PROTECTION DEVICE CAPABLE OF BEING PROVIDED ON A BOTTLE

RELATED APPLICATIONS

The present application is a Divisional of U.S. application Ser. No. 17/048,949, filed Oct. 19, 2020, which is a National Phase of International Application Number PCT/EP2019/059555, filed Apr. 12, 2019, which claims priority to French Application No. 1853479, filed Apr. 20, 2018, each of which are hereby incorporated by reference.

DOMAIN OF THE INVENTION

The present application relates to a device for protecting against shocks which can be used for containers of the bottle type, more specifically glass bottles.

A preferred application relates to pharmaceutical products, and preferably those for veterinary use, these products being advantageously in liquid form.

TECHNOLOGICAL BACKGROUND

Products for veterinary use, for example those used in farms, are often contained in glass containers (vials, flasks, bottle, etc.). Given the conditions wherein they are used, it is not rare that vials avoid being held by the operator (the veterinary surgeon or the farmer) and are inadvertently dropped on the ground during the handling of the product or movements. Thus, it occurs that the vials break. Regarding the cost of certain products, this loss has practical consequences (delay in the administration of the medication to the animal) and economic consequences (necessary replacement of the product to treat the animal).

Current protections for pharmaceutical products available on the market are plastic boxes which surround the vial containing the pharmaceutical product. They are expensive and have, in particular, as a disadvantage, that it is not possible to visually control the product level in the vial, the latter being very widely hidden by the plastic box. The user must thus remove the vial from the protection thereof who, due to this, loses their interest.

International application WO2014128179 A1 describes a device for protecting against shocks comprising an upper shell and a lower shell each including a stiffener in the form of a circular volume which extends projecting from the inner face of the cup making it possible to protect the vial in case of shock.

Moreover, patent publication U.S. Pat. No. 3,698,586 A1 discloses a protective device for glass containers, this device comprising two cover elements, one applicable at the level of the bottom of the container and the other applicable at the level of the shoulder of the latter. By means of a thermosetting material, equivalently described as thermosetting element, which is retracted around the container, an intimate engagement between the cover elements and the container is produced. Moreover, a visual access to the content is possible in the zone of the container situated at an intermediate level between the two cover elements. However, the capacity to dampen shocks conferred by this technical solution is not very convincing even though, under practical conditions wherein a fall of the container occurs up to human handling, the probabilities of breaking the glass container are highly increased. Moreover, the use of thermosetting material is not adapted to bottles containing heat-sensitive medications.

An aim of the present technique is to improve current protective techniques. Another aim of the technique is to propose an ergonomic alternative, easily grippable and is easily held in the hand of the operator.

SUMMARY

A first non-limiting aspect relates to a device for protecting against shocks capable of equipping a bottle, preferably a glass bottle, having a cylindrical body of completed revolution, at a first end, by a bottom and, at a second end opposite the first end, by a distal portion successively comprising from the body, along a longitudinal direction of the bottle, a shoulder, a collar and a neck, said device comprising a first cup configured to engage with the bottom of the bottle and a second cup configured to engage with the shoulder of the bottle, each of the first and second cups having a projecting portion for damping the shocks, along a transversal plane which is perpendicular to the longitudinal direction, beyond a zone of larger diameter of the bottle.

Advantageously, but in a non-limiting manner, according to a separable aspect, the portion projecting from the damping portion of at least one from among the first and the second cup includes a plurality of damping pads spaced apart from one another.

Thus, the pads confer to the cup which comprises them, a discontinuous circumference around the bottle. The pads form elements having a certain degree of freedom of movement against one another when they are urged during a shock. This freedom provides a better absorption of energy during shocks. Indeed, the deformation of the pads, preferably elastic, is larger than in the case of a damper continuously crossing the circumference of the bottle, if even more energy can be absorbed.

Advantageously, but in a non-limiting manner, according to another separable aspect, the portion projecting from the damping portion of at least one from among the first and the second cup is made of an elastomer, preferably an elastomer silicone or a thermoplastic elastomer polyurethane (TPE-U or TPU).

Another non-limiting aspect relates to a shock-resistant container, comprising: a bottle, preferably a glass bottle, having a cylindrical body of completed revolution, at a first end, by a bottom and, at a second end opposite the first end, by a distal portion successively comprising from the body, along a longitudinal direction of the bottle, a shoulder, a collar and a neck, and a device as described above.

Another non-limiting aspect relates to a method for assembling a protective device and a bottle, preferably comprising the implementation of the first cup and of the second cup around the bottle, by enlarging by elastic deformation of the material of the cups or by forceful insertion.

BRIEF INTRODUCTION OF THE DRAWINGS

Other features, aims and advantages will appear upon reading the following detailed description, and regarding the appended drawings given as non-limiting examples, and wherein.

Figure 4:
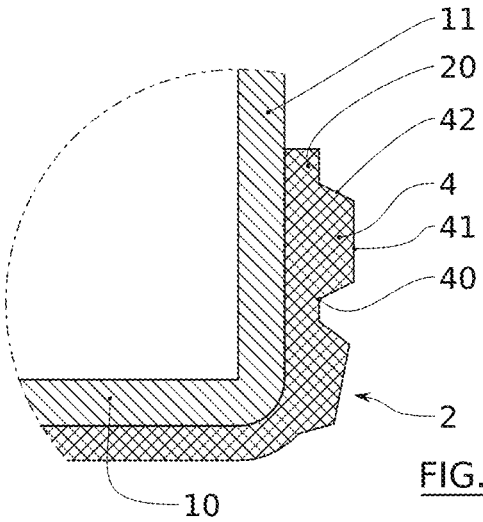
Figure 5:
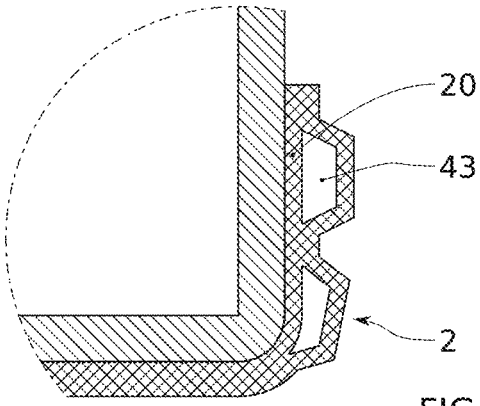
Figure 6:
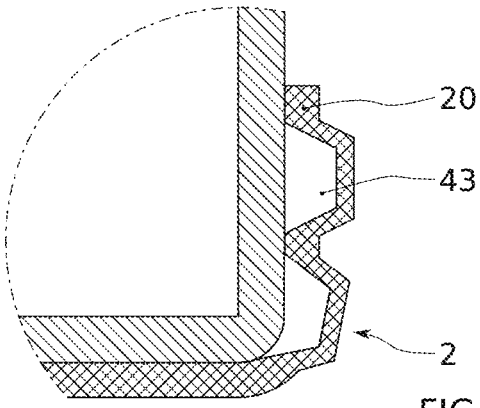

FIGS. 4 to 6 present three possible alternatives for forming pads with, respectively, solid, empty and hollow forms.

DETAILED DESCRIPTION

In the present application, the term "about", when it is used, means that the value can vary by more or less 10%.

Optionally, the optional features below can be incorporated, which could be used in association or alternatively:

- at least one from among the first 2 and the second cups 3 includes a base 20, 30 having an inner hollow portion of circular cross-section along the transversal plane 19, the inner portion being capable of engaging by contact with the circumferential surface of the bottle 1, the plurality of damping pads 4 being carried by an outer portion of the base 20, 30;
- at least some of the plurality of pads 4 is regularly distributed over the base 20 along the transversal plane 19;
- at least some of the plurality of pads 4 is arranged in a ring along the transversal plane 19;
- the pads 4 of the plurality of pads 4, each include a peak 41, the cumulated surface area of the peaks 41 being less than 75% of that of the outer portion of the base 20, 30, and preferably less than 65%;
- at least one of the plurality of pads 4 is solid and is made of a material which has a Shore A hardness comprised between 20 and 95, advantageously between 20 and 85, and preferably between 50 and 85;
- at least one of the plurality of pads 4 has an inner cavity;
- the inner cavity opens out at the level of the inner portion of the base 20, 30;
- the at least one of the plurality of pads 4 having an inner cavity is made of a material which has a Shore A hardness greater than 80, advantageously, greater than 90, and preferably greater than 95; these ranges can optionally extend as including a tolerance margin of more or less 10%;
- the plurality of pads 4 comprises at least one pad 4 of form selected from among: a polyhedron such as a truncated pyramid, a nib of circular or square cross-section, a mushroom, a half-sphere, a half-ellipsoid, a cone or a cone frustum;
- at least one from among the first 2 and the second cup 3 is made of a non-thermosetting material;
- the plurality of pads 4 is made of elastomer;
- the protective device only consists of the first 2 and second cups 3;
- the first cup 2 includes a portion for covering the bottom 20 of the bottle 1, said portion comprising a suction cup;
- at least one from among the first 2 and the second cup 3 comprises a preferably rupture zone, preferably in the longitudinal direction of the bottle; in particular in an embodiment, the first cup 3 includes a fragility zone or preferable rupture zone in the longitudinal direction of the bottle, facilitating the disconnection of the first cup 3 and of the bottle; in particular, in an embodiment, the second cup 2 includes a fragility zone or preferable rupture zone in the longitudinal direction of the bottle and/or in the portion for covering the bottom 20 of the bottle 1, facilitating the disconnection of the first cup 2 and of the bottle;
- the first cup 2 and the second cup 3 are formed of a material which is compatible with operations for recycling the material forming the bottle 1;
- the first cup 2 and/or the second cup 3 has a means for visually controlling the product level, equivalently described as controlling element, in the vial, advantageously in the form of a recess or a plurality of recesses in the first cup 2 and/or the second cup 3, arranged in the longitudinal direction of the bottle;
- the first cup 2 and/or the second cup 3 is formed in whole or in part of a transparent or translucid material, in particular for making it possible to visually control the product level in the vial,
- the first cup 2 and the second cup 3 are formed of a biodegradable or recyclable material;
- the first cup 2 and/or the second cup 3 can have a means for fastening the bottle to a support, equivalently described as fastening element.

Generally, the device is intended to be used for bottles, and particularly bottles which are reputed for being easily breakable given the intrinsic fragility of the material which composes them, the glass or also hard plastic materials. It can also be used with containers of which the content is brittle or erodible, such as pharmaceutical tablets. It has been observed by the applicant that it is advantageously made possible to decrease the physical degradation of the tablets contained in a pill container minimising the intensity of the shocks due to the falling of the container.

According to the present application, by "bottle", this means any container capable of receiving a product to be stored. The terms "vial", "flask", or others are considered as contained in the expression "bottle". The product to be stored can be in solid form, such as tablets, in particular pharmaceutical tablets, or in liquid form. Preferably, this is a product in liquid form. The bottle includes a bottom which forms the lower portion of it and generally configured so as to enable the holding in vertical position of the bottle when it is placed on a flat support.

The bottom is situated at a first end, lower end, of a body or drum. The latter is a cylindrical, hollow portion of circular cross-section, of which the directrix extends along a longitudinal direction of the bottle. At a second end, upper end opposite the lower end, the body is continued by a distal portion provided with a shoulder which forms a transition zone between the diameter of the body and the diameter of the upper portion of the bottle, the collar thereof.

The shoulder is thus itself of circular cross-section, but degressive towards the distal end of the bottle. The collar carries, itself, the mouth of the bottle, at the level of the neck thereof. The collar can have a fixed circular cross-section.

Figure 1:
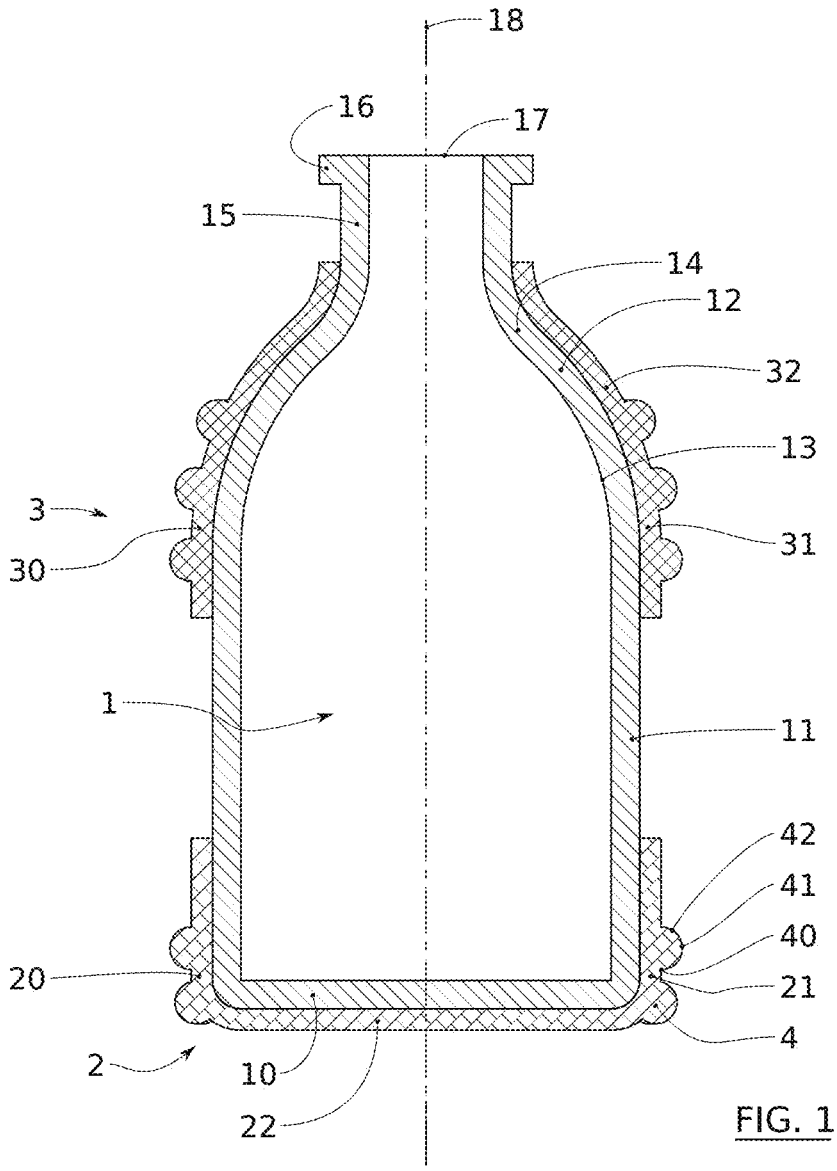
FIG. 1 is a cross-sectional view of a first embodiment applied to a bottle.

FIG. 1 gives a purely indicative example of such a bottle 1. A longitudinal direction 18 is defined there. Along this direction 18, the bottle 1 extends from the bottom 10 and includes a body 11 which here forms the major portion of the height of the bottle 1. The bottom 10 and the body 11 are connected by a fillet of the bottom 10, of convex form. At the second end thereof, the body 11 joins a transition portion, also called shoulder 12, at the level of a first connecting portion 13 of convex form. At this place, the diameter of the bottle starts to decrease. In the case illustrated, the shoulder 12 is ended by a second connecting portion 14 of the concave type being continued by the collar 15 of the bottle 1. The distal end of the latter is formed by the neck 16 having the mouth 17 making it possible for the insertion and the discharge of the product contained in the bottle 1. Of course, a closing device, typically a stop, can equip the bottle 1. It will be noted that the neck 16 can be threaded to engage with a such a stop. When the product contained in the bottle must be removed with a syringe, the mouth can be equipped with a septum or a transfer stop, for example a transfer stop of Adapta cap type (commercialised by the company Baxter), a transfer stop such as that described in international application WO 2016/166197, in particular a transfer stop such as that described in international application WO2018109215. Advantageously, the stop is separate from the protective device; it is preferably not covered by the cups 2, 3.

Preferably, the second cup 3 covers a zone of the container which is strictly below the collar so as to not interfere with the stop.

To prevent the breaking of a bottle in case of falling, a trivial solution consists of cover all of the outer surface of the bottle with a reinforcing element, for example a coating in the form of film or envelope made of thermoretractable polymer material. Advantageously, the protective device does not comprise such coatings and, on the contrary, proposes a protective device consisting only of separate and distant elements, spaced apart along the longitudinal direction of the bottle. Preferably, the device only comprises two elements, subsequently called first cup and second cup.

Each of the cups has a contact surface with the outer wall of a bottle 1, so as to be positionable, preferably fixedly, on such a bottle 1. By "fixedly", this means when the cup is in a suitable position on the bottle 1, it is secured to this bottle under normal conditions of use, outside of a specific effort of the user to seek to remove it. Preferably, this contact surface is defined by a cup base. This base has an inner portion, of which the surface is designed complementarily to the surface of the bottle wall portion on which it is intended to be applied.

In the embodiments illustrated, a first cup 2 is intended to engage with the bottom 10 of the bottle 1. Although this is not absolutely necessary, it is advantageous that this cup 2 includes a portion 22 for covering the bottom 10 of the bottle 1 and a portion 21 for partially covering the body 11. In this configuration, this first cup 2 defines a blind cavity and which can be snap-fitted by the bottom 10 of the bottle.

When the first cup 2 does not include any portion 22 for covering the bottom 10 of the bottle 1, the fixing of this cup 2 is done mainly by the portion 21 thereof covering the body. This portion 21 is consequently advantageously cylindrical, of circular cross-section, of a diameter configured to enable the snap-fitting of the first cup 2 around the body 11 of the bottle 1. The length of the snap-fitting, along the longitudinal direction 18 of the bottle 1 can vary according to the height of the body 11, of the resistance to the desired disconnection or also of the height of the desired uncovered zone for the bottle 1.

According to a first possibility, the material of the first cup 2 is rigid, for example in the form of a thermoplastic polymer, and the diameter thereof has a clamped adjustment relative to the diameter of the body 11 of the bottle 1.

According to another possibility, the material of the first cup 2 is an elastomer, such as natural rubber, a thermoplastic elastomer (TPE) or an elastomer silicone. In the sense of the present application, by "elastomer", this means any polymer which, when it is deformed at the ambient temperature, rapidly finds the size thereof and the original form thereof when the constraint at the origin of the deformation has been removed.

Elastomers having the features which are suitable for the device according to the present application are available on the market. Generic examples are natural rubber; thermoplastic elastomers such as thermoplastic elastomer olefins (TPE-O), styrene thermoplastic elastomers (TPE-S), vulcanised thermoplastic elastomer polypropylenes (TPE-V), copolyester thermoplastic elastomers (TPE-E), thermoplastic elastomer polyurethanes (TPE-U or TPU), and thermoplastic elastomer polyamides (TPE-A or TPA); and elastomer silicones. This is preferably thermoplastic elastomer polyurethanes (TPE-U or TPU) and elastomer silicones. Advantage can thus be drawn from the quite high friction coefficient of these types of materials for the holding on the bottle, that is also applying the first cup by deformation. In such a scenario, it is possible to extend elastically the material of the first cup to as to arrange around the bottle, then to release it.

Another option consists of using an assembly element between the cup 2 and the bottle 1; it can be glue or any other form of seal.

With the aim of reducing the ecological impact of the cups, the materials forming the cups are preferably recyclable or biodegradable. Thus, once the bottle is emptied of the content thereof, the cups can be separated from the bottle to be sent into a specific reprocessing circuit or reused in producing new products.

The term "biodegradable" is applied to materials which can decompose in a favourable environment (temperature, humidity, light, oxygen, etc.) and/or under the action of microorganisms (bacteria, fungi, algae) without any damaging effect on the environment by emitting, for example, water, carbon dioxide ($CO_2$) and/or methane ($CH_4$). Biodegradable material can, for example, be compostable.

The term "recyclable" is applied to materials which, after the use thereof in cups, can be collected and reused for producing an identical or different product. For example, 50% of elastomer silicones are currently reused in elastic coated road coverings or sport equipment grounds.

According to a possibility, the base 21 of the cup 2 is made of a first material, in particular those described above, and at least one other portion of the cup 2 is made of a second material, differing from the first. Optionally, the second material has a hardness less than that of the first. The elasticity module thereof, Young's modulus, can be smaller. Thus, more flexible or softer cup portion can be had. This can be useful to adjust the absorption of shocks, in particular when the second material is used for a damping portion described below.

This portion can be, for example, made of elastomer, while the base of the cup can be made of a non-elastomer polymer, for example, thermosetting.

Preferably, a material meeting the constraints above, and not requiring removal from the bottle 1 during glass recycling steps will be used. In particular, the material used can be compatible with the processing of recycling the bottle; it can be a calcination during the melting of the glass, for example. Any processing capable of making the material from device disappear (for example, by transforming it into material equivalent to that for recycling the container) during the recycling of the material of the bottle is considered as compatible.

Complementarily, or alternatively, at least one of the cups can contain a preferable rupture zone making it possible to remove it from the bottle 1. This zone can be a fragility zone; it can be a zone for concentrating mechanical stresses due to a decrease of cross-section of the cup at this place, to resorting to a material less resistant to this place, to a rupture onset (by a notch or precuts) at this place; for example, a portion of the cup can be finer or also be a precutting zone, as those that can be found on cans, facilitating the rupture of cups.

The first cup 2 and/or the second cup 3 can comprise an element for fixing the bottle to a support, in order to avoid having to hold it by hand. The presence of this fixing means, equivalently described as fixing element, moreover reduces the risks of the bottle falling, this being retained by said element for fixing to a support.

The element for fixing the bottle can be arranged on the cup 2, on the cup 3 or on the two cups, according to the use which is made of the bottle.

This element can be, for example, a precut zone arranged in the portion 22 for covering the bottom 10 of the bottle 1 which could be separated from the covering of the bottom 10 and provided with an orifice, wherein a fixing hook can pass. It can also be a hook or a snap hook, for example moulded in the material forming the cup or made of metal, advantageously applied in the moulded body of the cup.

The fixing element can be centred on the portion 22 so as to balance the container when it is suspended. In the case where a suction cup effect is produced by the portion 22 on the bottom, it can be used to increase the retention of the cup 2 on the bottle, even when a traction is performed on the fixing element.

Such a fixing element is, for example, advantageous when the product contained in the bottle must be administered by perfusion. In such a case, the fixing element is situated on the cup 2, preferably in the covering of the bottom 10 which makes it possible to suspend the bottle to a perfusion base.

The fixing element can also be used for attaching the bottle to a cord around the neck or to the belt of the user. The fixing element thus makes it possible for the user to transport the product while keeping their hands free for their operations. The fixing element is particularly advantageous for veterinary surgeons or for farmers who must administer a product by injection to a large number of animals repeatedly, for example in a stable as it makes it possible for them to have use of both their hands once the quantity is sampled in the bottle.

The device further includes a second cup 3 spaced apart from the first cup 2 along the longitudinal direction 18. Preferably, it can be positioned at the level of the shoulder 12 of the bottle 1. In the case illustrated, the second cup 3 includes a base 30 engaging with the wall of the bottle 1, in particular at the level of the shoulder 12. Given the transition of diameter of this portion of the bottle, the second cup 3 advantageously includes an equivalent profile, i.e. with a progressive decrease of the inner diameter thereof. In the most common case, of a shoulder 12 of convex connection profile from the body 11 then concave towards the collar 15, the second cup 3 can, for example, follow the same form as the convex portion of the shoulder 12. Preferably, at least one of the cups covers the portion(s) of the container which have the largest transversal dimension (i.e. generally the largest diameter for a container of circular cross-section); this can be in particular the case at the level of the shoulder 12.

A portion of the second cup 3 is applied moreover advantageously on an upper end portion of the body 11. Thus, as in the case of the first cup 2, the second cup 3 includes an inner cylindrical portion 31 applicable on the body 11 and, optionally, an additional portion, here applicable at the level of the shoulder 12 and optionally at the level of the collar 15. In this context, the second cup 3 therefore frames the shoulder, which is advantageous as it is a cross-section enlarging zone that it is useful to cover, as it is a favoured shock zone; what is more, this can be a zone for concentrating mechanical stresses due to the cross-section variation.

The description given above concerning the materials and the methods for fixing the first cup 2 is applicable to the second cup 3. It is not necessary, but only preferred, that the materials and the fixing methods are identical between the two cups 2 and 3.

Preferably, the bases 20, 30 of the cups 2 and 3 continuously cover the portions of the surface of the bottle on which they are applied.

Advantageously, the cumulated height of the cylindrical portions 21, 31 of the first and second cups 2 and 3 in contact with the body 11 of the bottle 1 represents less than one half, and preferably less than one third, of the height of the body 11. Thus, a good visual access is had to the content of the bottle 1 if the body 11 is transparent or at the least, translucid.

According to a variant, the visual access to the content of the bottle is facilitated by the presence, in the first cup 2 and/or the second cup 3 of a member for visually controlling the product level in the vial.

Such a control of the product level is particularly advantageous, as it makes it possible to evaluate the number of remaining doses when the product is, for example, administered with a syringe or in the case of a perfusion, namely at which moment the bottle must be changed.

The member for controlling the product level in the vial can be arranged in the first cup 2 when the bottle is intended to be used with the head at the bottom, where in the second cup 3 when the bottle is intended to be used with the head at the top or in the two cups.

This means for visually controlling the product level, or equivalently controlling element, in the vial can have different forms. It can be a recess or a plurality of recesses arranged in the longitudinal direction of the bottle. By "recess", this means a zone of the cup not having any material making it possible for a visual access to the content of the bottle.

Alternatively, the member for visually controlling the product level in the vial can result in the use of a transparent or sufficiently translucid material to have a visual access to the content of the bottle to manufacture the cup. The transparent material can form all of the cup or only one portion of it, preferably in the form of a line arranged in the longitudinal direction of the bottle.

The means for visually controlling the product, or equivalently controlling element, can also be accompanied by a graduation such as an indication of the remaining volume or of the number of remaining doses.

According to a preferred variant, the first and the second cup 2 and 3 each include a fragility zone or preferably rupture zone in the longitudinal direction 18 of the bottle. This preferable rupture zone makes it possible for the operator, if the materials forming the bottle and cups must not be removed in the same circuit for reprocessing waste, for example if the materials forming the cups are biodegradable or recyclable, to make it possible and/or to facilitate the disconnection of the cups 2 and 3 and of the bottle 1 and to remove, as waste, the bottle 1 and the cups 2 and 3, each in the respective circuits therefor for reprocessing waste. It is a clear advantage for respecting the environment, which is particularly important in the pharmaceutical field.

Also, according to another variant, the first cup 2 and the second cup 3 are formed of a material compatible with the operations of recycling the material forming the bottle 1.

Below in the description, a radial orientation along which the cross-section of the body 11 is circular is defined by a transversal plane 19 (which is perpendicular to the longitudinal direction of the cylindrical body of the bottle). The orientation of this plane 19 is, in particular represented in FIG. 3.

It is understood that to be able to effectively protect the bottle 1, the device must generally come into contact with a surface on which the bottle 1 can be broken before the outer wall of the bottle.

Starting with the principle that such a surface is generally the ground and/or is substantially flat, it must be that the cups have portions extending along the transversal plane, beyond the largest dimensions of the bottle along this direction, i.e. beyond the diameter of the body. Thus, in case of a fall, it is a priority of either of the cups which will come into contact with the surface on which the bottle could be broken. In this context, the cups 2 and 3 include a damping portion of which at least one portion extends radially beyond the body so as to form an excrescence on the bottle along the transversal plane. The dimension of this extension is not limiting, but preferably, the thickness of a damping portion can represent a projection of at least 5% of the diameter of the body.

The damping portion comprises a plurality of pads 4.

By "pad", this means any element having a form projecting to the surface of the considered cup 2 or 3 without it covering only all of the circumference of the cup. The damping portion is therefore not a continuous protrusion surrounding the bottle 1. These pads 4 form damping elements made on either side of one another on at least one of the cups 2, 3 by projecting radially from the portion of the cup in contact with the bottle 1. By "radially", this means that the pads have a component directed outwards in the transversal plane; for all that, the pads can have another component, for example, along the longitudinal direction, so as to have an inclination relative to the transversal plane; in the transversal plane, the pads 4 do not have, moreover, necessarily, a direction directed along a radius of the body of the bottle.

An assumption is not made on the forms and dimensions of the pads 4.

Furthermore, pads 4 of different forms and/or dimensions can coexist on one same cup. Said damping elements in the form of pads can have any geometry: conic, triangular, pyramidic, cylindrical, polyhedric, ellipsoidal.

Advantageously, they are of polyhedric form, preferably parallelepiped or cubic. They can have an axial symmetry along the direction of extension thereof outwards from the cup.

Preferably, all the damping elements of a cup have the same form, which is preferably parallelepiped or cubic or truncated pyramid.

According to an embodiment, at least some of the pads 4 are regularly spaced apart so as to periodically surround all of the circumference of the bottle 1. In this context, in the transversal plane 19, the gap between any two adjacent pads is constant. Alternatively or complementarily, the pads 4 can be regularly spaced apart along the longitudinal direction 18, in several stages. Preferably, several rows of pads are arranged (along the transversal plane 19) and these pads 4 can form columns along the longitudinal direction 18. A staggered distribution is also possible, the pads 4 of two superposed rows thus being laterally offset. The suitable number of pads 4 depends, in particular, on the form and on the height of the pads, as well as the relative position thereof and the distribution thereof to the surface of the cup. It also depends on the weight and the dimensions of the bottle, in particular on the height thereof. Advantageously, the pads 4 are distributed over one or more rows, more specifically over 1 to 10 rows, for example, 1, 2, 3, 4, 5, 6, 7, 8, 9 or 10. The suitable number of rows of pads, the dimension of the pads and the arrangement of the pads can be determined for each bottle by tests such as those described in the examples.

Figure 2:
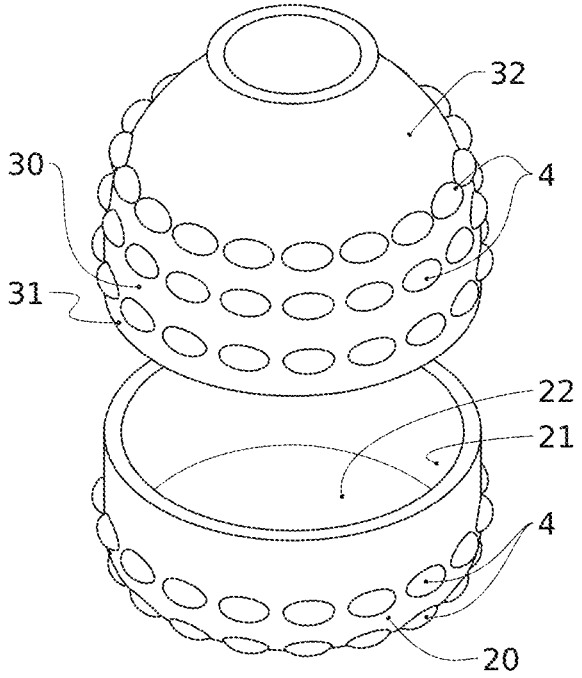
FIG. 2 is a perspective representation of the device according to the first embodiment.

The example of FIG. 2 illustrates these possibilities. In particular, the first cup 2 includes pads 4 organised in two rows. The pads 4 of the rows are strictly superposed, so as to be aligned along the longitudinal direction 18. The second cup 3 itself has three rows of pads 4. Furthermore, these rows do not have the same spacing between the pads 4 even though the latter are not aligned along the longitudinal direction 18. It will be noted that the density of pads 4 is greater in the intermediate row which is intended to be applied at the level of the convex portion of the shoulder 12.

Figure 3:
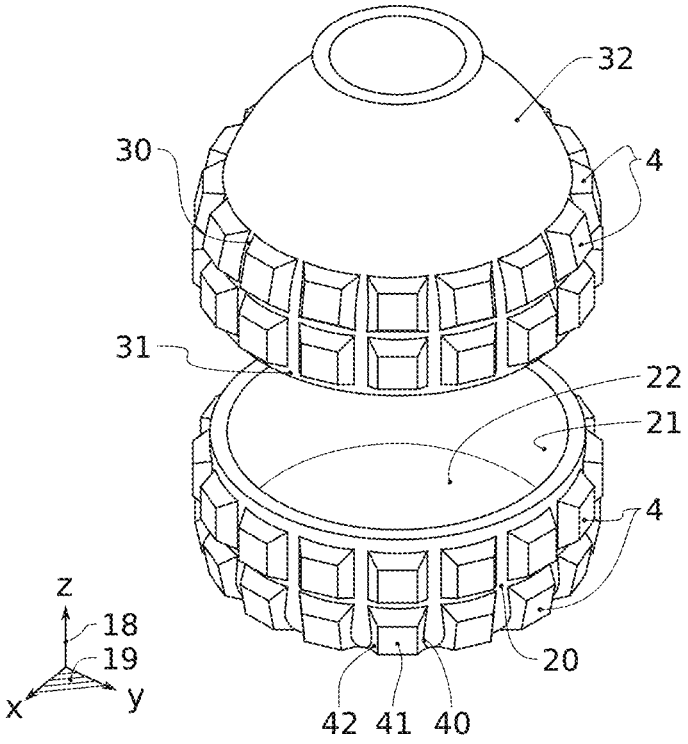
FIG. 3 is a perspective representation of the device according to a second embodiment.

FIG. 3 has an alternative constitution of the cups 2 and 3. The base 20 and 30 of the cups 2 and 3 is of the same form as in the case of FIG. 2. This portion forms, in both cases, the envelope of which the inner portion is applied on the outer wall of the bottle. However, the pads 4 are of different forms. Generally, the pads 4 include a proximal end 40 at the level of the connection thereof with the base of the cup considered, a trunk 42 projecting from the proximal end 40 in the direction of a peak 41. Preferably, the peak of the pads is pointed, or is flat (or of rectilinear profile in at least one direction of the space) or also of convex form. It does not thus form a high crater.

In the case of FIG. 2, the pads 4 are ellipsoidal forms, in particular half-ellipsoids, for example solid. The proximal end 40 thereof forms therefore an ellipsis at the junction with the base of the cup and the peak 41 is the distal end of a convex profile. In the case illustrated, the large axis of the elliptic form is directed in the transversal plane 19, but it could also be directed along the longitudinal direction 18 or along other orientations. Other curved forms are also possible.

In the case of FIG. 4, two rows of pads 4 aligned along the longitudinal direction 18 are formed on each of the cups 2 and 3. In this example, the pads 4 are truncated pyramids: the proximal end 40 thereof forms a rectangular or square closed contour at the level of the junction with the base of the cup, the trunk 42 is forms of four sides organised as the phases of a pyramid, and the peak 41 corresponds to a cross-sectional plane of this geometric pyramid. This example can be generalised to other forms of trunk 42 formed on the base of a polyhedron. FIG. 4 moreover shows that the pads 4 can join at the level of the base, as is the case for the second cup 3 in this figure. However, the pads 4 of the first cup 2 have distant proximal ends 40 so as to completely space the pads 4 apart, not only at the level of the trunks 42 thereof and the peaks 41 thereof, but also at the level of the bases thereof.

It is advantageous that the pads are arranged equidistantly to distribute the contact surface with the ground and therefore to distribute the mechanical effects of the shocks on a plurality of pads.

For example, a bottle of which the body has a diameter comprised between 64.8 and 67.2 mm can be equipped. In this context, at least two rows, even at least three rows of pads can be formed by cups. Each row of pads has an annular carrier which preferably extends along the transversal plane. A row can comprise at least five pads and possibly at least ten pads. The projection that represents a pad is advantageously of at least 5 mm, preferably at least 7 mm; it can be less than 10 mm.

The pads 4 or some of them can be empty, hollow or solid:

by "empty", this means that the damping pad 4 has an inner cavity which forms a pocket surrounded by material forming the pad 4, for example made of elastomer, and containing air. This pocket is however not systematically airtight, insofar as the material can be porous or insofar as at least one of the walls of the pocket can have air vents. However, generally, the pocket defines a closed volume, surrounded by a mainly continuous wall. Thus, a cell or an air cell filled with air is defined, and the compression of the air contributes to the damping. FIG. 5 gives an example of configuration of pads 4 including a closed inner cavity 43 forming an air pocket, preferably sealed, the inner cavity 43 and the outer wall of the bottle being separated by the base 20 of the cup (here, this is not limiting of the first cup 2).

by "hollow", this means that the damping pad 4 is not delimited by a bottom in contact with the bottle 1. The inner cavity of the pad 4 thus opens out over the outer wall of the bottle 1; in this configuration, the contact between the base 20, 30 of the cup 2, 3 and the outer wall of the bottle 1 is discontinuous, as interrupted to the right of the mouths of the inner cavities of the pads 4; the flexibility of the pads 4 can be increased by this means. FIG. 6 has this hollow solution, the inner cavity 43 of the pads 4 opening out at the level of the outer wall of the bottle 1.

by "solid", this means that the damping pad 4 forms a solid element, filled with material. FIG. 4 has such a configuration, wherein the pads 4 are totally filled with material. The pads 4 are thus in the physical continuity of the material of the base 20, 30 of the cup considered, here the first cup 2. The proximal end 40 of the pads 4 is, moreover represented as the junction point with the base 20.

When the damping element is solid, preferably an elastomer is used, for example thermoplastic, having a lower Shore hardness than for an empty or hollow damper. An elastomer having a Shore A hardness going from 20 to 95 can be suitable. Advantageously, the Shore A hardness goes from 20 to 85, preferably from 50 to 85, even more preferably from 75 to 85, for example, 75, 76, 77, 78, 79, 80, 81, 82, 83, 84, or 85. In this case, the energy due to the shock is absorbed by the deformation of the material. According to a preferred variant, an elastomer silicone is used, having a Shore A hardness going advantageously from 50 to 85, preferably from 75 to 85, for example, 75, 76, 77, 78, 79, 80, 81, 82, 83, 84, or 85, in particular having a Shore A hardness of about 80. According to another preferred variant, a thermoplastic elastomer polyurethane (TPE-U or TPU) is used, having a Shore A hardness of 50 to 85, preferably from 75 to 85, for example, 75, 76, 77, 78, 79, 80, 81, 82, 83, 84, or 85, in particular having a Shore A hardness of about 85.

When the damping element is empty or hollow, an elastomer can be resorted to, for example thermoplastic, having a Shore A hardness of at least 80, advantageously of at least 85, more advantageously of at least 90, and preferably of at least or equal to 95.

In the present application, the Shore A hardness of the elastomer is determined according to the standard ATSM-2240 (*Standard Test Method for Rubber Property—Durometer Hardness*).

It will be noted that it is possible to equip pads 4 with the portion 22 for covering the bottom 10 of the bottle 1, even if this is not represented. Generally, the pads 4 can be installed at any useful place of either of the cups 2 and 3. According to another possibility, the portion 22 is equipped with a suction cup arranged on the outer wall of the portion 22 so as to favour the adherence by vacuum effect on a surface.

The device for protecting bottles can be usefully implemented and used to prevent the falling of the bottle by offering an improved gripping of the bottle by consumers/operators, to protect the bottle from breaking in case of falling, as well as to protect the content of the bottle from a degradation following the shock resulting from a falling of the bottle. The device is particularly adapted to the protection of bottles and the content thereof in the pharmaceutical or cosmetic field, but also to protect bottles in the agribusiness or general commodity fields (oils, vinegars, wines, dangerous products, etc.).

The cups can be formed by injection, preferably by injection with one single material, by overmoulding, by bi-injection, by 3D printing, by thermoforming, by thermocompression, or also by injection moulding.

3D printing can be advantageously used for manufacturing cups including empty damping pads and/or having a reading window in the form of a recess or a plurality of recesses arranged, for example, in the longitudinal direction of the bottle. Moreover, 3D printing can also be used to manufacture cups formed of a transparent or translucid material (by using materials of 3D printing technology having properties adapted to form a transparent surface).

Thermocompression and injection moulding are advantageously used for the manufacture of cups including solid or hollow pads. When the material used is an elastomer silicone, the cups are preferably manufactured by thermocompression, for example in a vulcanising press.

In another variant, the present technique relates to a device for protecting against shocks capable of equipping a bottle 1, having a cylindrical body 11 of completed revolution, at a first end, by a bottom 10 and at a second end opposite the first end by a distal portion successively comprising from the body 11, along a longitudinal direction of the bottle 1, a shoulder 12, a collar 15 and a neck 16, said device comprising a first cup 2 configured to engage fixedly with the bottom 10 of the bottle 1 and a second cup 3 configured to engage fixedly with the shoulder 12 of the bottle 1, each of the first and second cups 2, 3 having a portion for damping shocks capable of projecting, along a transversal plane 19 which is perpendicular to the longitudinal direction 18, beyond a zone of larger diameter of the bottle 1, wherein the portion projecting from the damping portion of at least one from among the first 2 and the second cup 3 is made of an elastomer, preferably an elastomer silicone or a thermoplastic elastomer polyurethane (TPE-U or TPU). This aspect forms an aspect separable from the present application, which could be implemented separately from the embodiments considered above, in particular in reference to the cases illustrated.

Abovementioned international application WO2014128179 A1 describes a device for protecting against shocks comprising an upper shell and a lower shell each including a stiffness in the form of a circular volume which extends projecting from the inner face of the cup making it possible to protect the vial in case of shock. Said stiffness can also be oriented longitudinally with respect to the vial. The cups have forms which define with the wall of the vial, annular volumes filled with air which contribute to the absorption of shocks. The cups are formed of an injectable resin. The polymer used to manufacture cups described in this application is low-density polyethylene. The hardness of such materials is generally measured on the Shore D scale and is of the order of 60.

The inventors of the present application have highlighted that a device according to this variant makes it possible, with equal geometric configuration but formed of an elastomer, to significantly improve the resistance of a bottle during a fall. The device also makes it possible to avoid a thermoretractable sleeve, thus resulting in a saving of material and to avoid subjecting the product contained in the bottle to heat.

According to this variant, the damping portion can advantageously be a plurality of pads such as described above or a solid, empty or hollow annular volume. Preferably, the annular volume is empty. The annular volume preferably extends over the whole of the circumference of the bottle and advantageously forms a projection of constant thickness, in the form of a toroid, for example or of another form of protrusion.

The features relating to the forms of the cups, the pads, the materials, as well as all the advantageous features are also valid for this variant, subject to them not being technically incompatible.

Thus, advantageously, when the damping element is empty or hollow, an elastomer can be resorted to, having a Shore A hardness of at least 80, advantageously of at least 85, more advantageously of at least 90, and preferably of at least or equal to 95. When the damping element is solid, advantageously an elastomer is used, having a Shore A hardness going from 20 to 95. More advantageously, the Shore A hardness goes from 20 to 85, advantageously from 50 to 85, preferable from 75 to 85, for example, 75, 76, 77, 78, 79, 80, 81, 82, 83, 84, or 85. According to a preferred variant, an elastomer silicone is used, having a Shore A hardness going advantageously from 50 to 85, preferably from 75 to 85, for example, 75, 76, 77, 78, 79, 80, 81, 82, 83, 84, or 85, in particular having a Shore A hardness of about 80. According to another preferred variant, a thermoplastic elastomer polyurethane (TPE-U or TPU) is used, having a Shore A hardness going advantageously from 50 to 85, preferably from 75 to 85, for example, 75, 76, 77, 78, 79, 80, 81, 82, 83, 84, or 85, in particular having a Shore A hardness of about 85. In this case, the energy due to the shock is absorbed by the deformation of the material.

A protocol used to test the effectiveness of the different protective devices is described below:

A 250 ml vial filled with water is equipped with the device formed of a thermoplastic elastomer polyurethane (TPE-U or TPU) (Shore hardness 85A). The lower cup covers about 30% of the low portion of the vial (bottom included) and the upper cup itself also covers about 30% of the outer surface of the vial. The overall thickness of the projecting portion and of the base is 7 mm and the vial has a diameter of 66 mm.

It is dropped on a building block in order to simulate a concrete floor, that it can be considered as an extreme case, from different heights (80 cm or 120 cm) and in a situation, wherein the vial is coated.

When the vial has resisted; it is dropped a second time. If the vial has resisted again, it is dropped under the same conditions a third time.

Each device for protecting against the shocks is tested ten times.

The results are expressed as a percentage of the number of vials intact as follows:

$1^{st}$ throw: 8 vials out of 10 resistant=80%

$2^{nd}$ throw: 4 vials out of initial 10 resistant=40%

$3^{rd}$ throw: 2 vials out of initial 10 resistant=20%

The results have been as follows:

| Test Coated vial (falling height 80 cm) | Empty vial | Vial with two cups made of low-density polyethylene (Shore D hardness 60) each including an empty annular volume | Vial with two cups made of elastomer of the thermoplastic polyurethane type (Shore A hardness 85) each including an empty annular volume | Configuration corresponding to FIG. 3, the pads being solid, with two cups made of thermoplastic polyurethane (Shore A hardness 85) | Configuration corresponding to FIG. 3, the pads being empty with two cups made of thermoplastic polyurethane (Shore A hardness 95) |
|---|---|---|---|---|---|
| Fall 1/3 | 0% | 60% | 80% | 100% | 100% |
| Fall 2/3 | 0% | 40% | 40% | 100% | 100% |
| Fall 3/3 | 0% | 20% | 40% | 100% | 90% |

When the dampers are of equivalent form (empty damping volume), the resistance to the shock is very clearly improved with a device formed of an elastomer material (Shore A hardness 85) instead of low-density polyethylene.

It will be noted that with an equivalent material, the present of pads forming a discontinuous damping surface very clearly improves the resistance to shocks with respect to a continuous damping surface.

It has been observed that the gripping of a bottle equipped with the device is particular good (better than that of a bottle without device and better than that of a bottle equipped with two cups, each including an empty annular protrusion). The pads distributed over the cups contribute actively to the improved ergonomics and the visibility of the water level contained in the bottle is excellent.

By implementing the same protocol as above, tests are carried out with the following cups:

a) Configuration corresponding to FIG. 3, the pads being solid, with two thermoplastic elastomer polyurethane (Shore A hardness 85) obtained by 3D printing:

| Position of the vial (falling height) | Coated (80 cm) | Coated (120 cm) | Upright (120 cm) |
|---|---|---|---|
| Fall 1 | 90% | 90% | 60% |
| Fall 2 | 90% | 90% | 60% |
| Fall 3 | 90% | 90% | 60% |

b) Configuration corresponding to FIG. 3, the pads being solid, with two SEBS-based thermoplastic elastomer (polystyrene-b-poly(ethylene-butylene)-b-polystyrene) having a Shore A hardness of 60, obtained by injection:

| Position of the vial (falling height) | Coated (80 cm) | Coated (120 cm) | Upright (120 cm) |
|---|---|---|---|
| Fall 1 | 100% | 80% | 10% |
| Fall 2 | 100% | 60% | 0% |
| Fall 3 | 100% | 40% | 0% |

c) Configuration corresponding to FIG. 3, the pads being solid, with two elastomer silicon cups (Shore hardness 80A, Cenusil® R commercialised by the company Wacker Chemie), obtained by thermocompression:

| Position of the vial (falling height) | Coated (80 cm) | Coated (120 cm) | Upright (120 cm) |
|---|---|---|---|
| Fall 1 | 90% | 90% | 90% |
| Fall 2 | 90% | 90% | 90% |
| Fall 3 | 90% | 90% | 40% |

REFERENCES

1. Bottle

10. bottom

11. body
12. shoulder
13. first connection
14. second connection
15. collar
16. neck
17. mouth
18. longitudinal direction
19. transversal plane
2. First cup
20. base
21. cylindrical portion
22. bottom covering portion
3. Second cup
30. base
31. cylindrical portion
32. shoulder covering portion
4. Pads
40. proximal end
41. peak
42. trunk
43. inner cavity

The invention claimed is:

1. A device for a bottle to protect against shocks, the bottle having a cylindrical body of revolution ended, the cylindrical body having a bottom at a first end and a distal portion at a second end opposite the first end, the body successively including, from the distal portion along a longitudinal direction of the bottle, a shoulder, a collar and a neck, the bottle having a zone with a larger diameter than another zone of the bottle, said device comprising:

a first cup configured to engage with the bottom of the bottle; and a second cup configured to engage with the shoulder of the bottle, each of the first cup and second cup having a damping portion for damping the shocks, the damping portion projecting, along a transversal plane which is perpendicular to the longitudinal direction, beyond the zone of the larger diameter of the bottle, wherein the damping portion of each of the first cup and the second cup includes a plurality of pads spaced apart from one another, the plurality of pads being regularly distributed in a discrete manner along the transversal plane, wherein the plurality of pads is made of an elastomer material, wherein the first cup and the second cup each include a base having an inner hollow portion of a circular cross-section along the transversal plane, the inner hollow portion being configured to engage the bottle by contacting with a circumferential surface of the bottle, and an outer portion carrying the plurality of pads, and wherein the plurality of pads is solid and the elastomer material a Shore A hardness between 20 and 95.

2. The device according to claim 1, wherein at least one portion of the plurality of pads is arranged in a ring along the transversal plane.

3. The device according to claim 1, wherein the plurality of pads of the first and second cups each includes a peak, a cumulated surface area of the peaks being less than 75% of that of the outer portions of the bases of the first and second cups.

4. The device according to claim 1, wherein the elastomer material is an elastomer silicone which has a Shore A hardness going from about 75 to about 85, or an elastomer polyurethane (TPE-U or TPU) which has a Shore A hardness going from about 75 to about 85.

5. The device according to claim 1, wherein the plurality of pads comprises at least one pad having a form selected from the group consisting of a polyhedron, a nib of a circular or square cross-section, a mushroom, a half-sphere, a cone or a cone frustum, and a half-ellipsoid.

6. The device according to claim 1, wherein at least one of the first cup or the second cup is made of a non-thermosetting material.

7. The device according to claim 1, wherein at least one of the first cup or the second cup comprises a rupture zone configured to extend in the longitudinal direction of the bottle.

8. The device according to claim 3, wherein the cumulated surface area of the peaks is less than 65% of that of the outer portion of the base.

9. The device according to claim 1, wherein the Shore A hardness is between 20 and 85.

10. The device according to claim 1, wherein the Shore A hardness is between 50 and 85.

11. A device for a bottle to protect against shocks, the bottle having a cylindrical body of revolution ended, the cylindrical body having a bottom at a first end and a distal portion at a second end opposite the first end, the body successively including, from the distal portion along a longitudinal direction of the bottle, a shoulder, a collar and a neck, the bottle having a zone with a larger diameter than another zone of the bottle, said device comprising:

a first cup configured to engage with the bottom of the bottle; and a second cup configured to engage with the shoulder of the bottle, each of the first cup and second cup having a damping portion for damping the shocks, the damping portion projecting, along a transversal plane which is perpendicular to the longitudinal direction, beyond the zone of the larger diameter of the bottle, wherein the damping portion of each of at least one from among the first cup and the second cup includes a plurality of damping pads spaced apart from one another, the plurality of damping pads being regularly distributed in a discrete manner along the transversal plane, wherein the plurality of damping pads is made of an elastomer material, wherein the first cup and the second cup each include a base having an inner hollow portion of a circular cross-section along the transversal plane, the inner hollow portion being configured to engage the bottle by contacting with a circumferential surface of the bottle, and an outer portion carrying the plurality of damping pads, and wherein the plurality of damping pads has an inner cavity and the elastomer material has a Shore A hardness greater than 90.

12. The device according to claim 11, wherein at least one portion of the plurality of damping pads is arranged in a ring along the transversal plane.

13. The device according to claim 11, wherein the plurality of damping pads of the first and second cups each includes a peak, a cumulated surface area of the peaks being less than 75% of that of the outer portions of the bases of the first and second cups.

14. The device according to claim 13, wherein the cumulated surface area of the peaks is less than 65% of that of the outer portions of the bases of the first and second cups.

15. The device according to claim 13, wherein at least one portion of the plurality of damping pads is arranged in a ring along the transversal plane.

16. The device according to claim 12, wherein the plurality of damping pads of the first and second cups each includes a peak, the cumulated surface area of the peaks being less than 75% of that of the outer portions of the bases of the first and second cups.

17. The device according to claim 11, wherein the inner cavity opens out at a level of the inner hollow portion of the base.

18. The device according to claim 11, wherein the elastomer material has a Shore A hardness greater than 95.

19. The device according to claim 11, wherein the plurality of damping pads comprises at least one pad having a form selected from the group consisting of a polyhedron, a nib of a circular or square cross-section, a mushroom, a half-sphere, a cone or a cone frustum, and a half-ellipsoid.

20. The device according to claim 11, wherein at least one of the first cup or the second cup is made of a non-thermosetting material.

21. The device according to claim 11, wherein at least one of the first cup or the second cup comprises a rupture zone configured to extend in the longitudinal direction of the bottle.

22. A shock-resistant container, comprising:

a bottle, having a cylindrical body of revolution ended, the cylindrical body having a bottom at a first end, and a distal portion at a second end opposite the first end, the body successively comprising from the distal portion along a longitudinal direction of the bottle, a shoulder, a collar and a neck, and the device according to claim 1.

23. The container according to claim 22, wherein the bottle contains a pharmaceutical product-for veterinary use.

24. The container according to claim 22, wherein the first cup and the second cup are separated and spaced apart along the longitudinal direction.

25. The container according to claim 22, wherein the second cup covers the shoulder.

* * * * *